US009608381B2

(12) United States Patent
Yang et al.

(10) Patent No.: US 9,608,381 B2
(45) Date of Patent: Mar. 28, 2017

(54) RECEPTACLE CONNECTOR AND RECEPTACLE CONNECTOR ASSEMBLY

(71) Applicant: Cheng Uei Precision Industry Co., Ltd., New Taipei (TW)

(72) Inventors: Cheng-Wang Yang, Dong-Guan (CN); Kai-Hsiang Chang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/840,046

(22) Filed: Aug. 30, 2015

(65) Prior Publication Data

US 2017/0062990 A1 Mar. 2, 2017

(51) Int. Cl.
*H01R 13/648* (2006.01)
*H01R 13/6585* (2011.01)
*H01R 25/00* (2006.01)

(52) U.S. Cl.
CPC ..... *H01R 13/6585* (2013.01); *H01R 25/00* (2013.01)

(58) Field of Classification Search
CPC ..... H01R 13/6585; H01R 25/00
USPC ..... 439/607.05, 607.23, 607.24, 607.25, 439/607.26, 540.1, 541.5
See application file for complete search history.

(56) References Cited

U.S. PATENT DOCUMENTS 5,676,569 A * 10/1997 Davis ..... H01R 13/518 439/540.1
6,568,958 B2 * 5/2003 Zhang ..... H01R 13/6485 439/540.1
7,871,294 B2 * 1/2011 Long ..... G02B 6/0001 439/540.1
8,226,439 B2 * 7/2012 Lai ..... H01R 13/6594 439/607.23
8,292,674 B1 * 10/2012 Yang ..... H01R 12/57 439/587
8,454,382 B2 * 6/2013 Zhang ..... H01R 13/514 439/540.1
8,864,523 B2 * 10/2014 Banakis ..... H01R 13/6585 439/607.25
8,870,595 B2 * 10/2014 Schmitt ..... H01R 13/6587 439/607.25
8,974,248 B2 * 3/2015 Lan ..... H01R 13/405 439/607.01

(Continued)

*Primary Examiner* — Abdullah Riyami
*Assistant Examiner* — Nelson R Burgos-Guntin
(74) *Attorney, Agent, or Firm* — Cheng-Ju Chiang

(57) ABSTRACT

A receptacle connector assembly includes a plurality of receptacle connectors stacked up and down and fastened together. The receptacle connector includes a first terminal module, two second terminal modules, two middle shielding plates, two docking modules, and a shielding shell surrounding the first terminal module, the second terminal modules, the middle shielding plates and the docking modules. The first terminal module includes a first base block which has a first fastening portion. Two side surfaces of the first fastening portion protrude upward and outward to form two flanks. Each of the second terminal modules has a second base block. Each of the middle shielding plates is mounted between one of the flanks and the corresponding second base block. The two docking modules are mounted to the first terminal module, the two middle shielding plates and the two second terminal modules.

20 Claims, 14 Drawing Sheets

(56) References Cited

U.S. PATENT DOCUMENTS

| | | | | |
|---|---|---|---|---|
| 9,130,292 | B1 * | 9/2015 | Xie | H01R 13/405 |
| 2002/0048992 | A1 * | 4/2002 | Wang | H01R 24/62<br>439/607.23 |
| 2003/0082951 | A1 * | 5/2003 | Moriwake | H01R 12/707<br>439/607.05 |
| 2012/0322308 | A1 * | 12/2012 | Fogg | H01R 13/6587<br>439/607.25 |
| 2014/0364008 | A1 * | 12/2014 | Simmel | H01R 13/64<br>439/607.23 |
| 2015/0171560 | A1 * | 6/2015 | Yu | H01R 13/6593<br>439/607.25 |
| 2016/0141808 | A1 * | 5/2016 | Stowers | H01R 24/84<br>439/607.05 |

* cited by examiner

RECEPTACLE CONNECTOR AND RECEPTACLE CONNECTOR ASSEMBLY

BACKGROUND OF THE INVENTION

1. Field of the Invention

The present invention generally relates to a connector, and more particularly to a receptacle connector and a receptacle connector assembly.

2. The Related Art

With the development of electronic technologies, electronic connectors are widely applied in various fields. Currently, an electronic device is equipped with multiple receptacle connectors for realizing electrical signal transmissions between the electronic device and multiple electrical components.

However, when the receptacle connectors are soldered to a circuit board, the receptacle connectors will occupy a larger area of the circuit board, in addition, the receptacle connectors need be placed on the circuit board one by one that will waste working hours. As a result, production efficiency is lowered.

So, it's essential to provide an innovative receptacle connector and a receptacle connector assembly including a plurality of the innovative receptacle connectors, when the innovative receptacle connectors are soldered to the circuit board, the innovative receptacle connectors of the receptacle connector assembly will just occupy a smaller area of the circuit board, and the innovative receptacle connectors of the receptacle connector assembly just need be placed on the circuit board once for saving the working hours. As a result, the production efficiency is improved.

SUMMARY OF THE INVENTION

An object of the present invention is to provide a receptacle connector and a receptacle connector assembly. The receptacle connector assembly includes a plurality of receptacle connectors stacked up and down and fastened together. The receptacle connector includes a first terminal module, two second terminal modules, two middle shielding plates, two docking modules and a shielding shell. The first terminal module includes a first base block and two groups of first terminals. The first base block has a first fastening portion. Upper portions of rear ends of two side surfaces of the first fastening portion protrude upward and outward to form two flanks. The two groups of the first terminals are respectively fastened to the two flanks. Rear ends of the first terminals project beyond rear surfaces of the two flanks. Front ends of the first terminals project beyond front surfaces of the two flanks. Each of the second terminal modules has a second base block and a group of second terminals. The second base blocks of the two second terminal modules are respectively fastened to bottom surfaces of the two flanks. The two groups of the second terminals are respectively fastened to the two second base blocks. Rear ends of the second terminals project beyond rear surfaces of the second base blocks. Front ends of the second terminals project beyond front surfaces of the second base blocks. Each of the middle shielding plates is mounted between one of the flanks and the corresponding second base block. Front ends of the middle shielding plates project beyond the front surfaces of the flanks and the second base blocks. Each of the docking modules includes a docking portion. The docking portion defines a docking chamber penetrating through a front surface of the docking portion. The docking portion defines an assembling opening penetrating through a rear surface of the docking portion. The docking chamber and the assembling opening are isolated by an isolating board. A middle of the isolating board protrudes frontward to form a tongue board. The docking portion defines a fastening slot longitudinally penetrating through a middle of the isolating board and extending to a front of the tongue board, and further penetrating through two opposite side surfaces of the tongue board. The docking portion defines a plurality of first terminal grooves penetrating through an upper portion of the isolating board and a top surface of the tongue board, and a plurality of second terminal grooves penetrating through a lower portion of the isolating board and a bottom surface of the tongue board. The two docking modules are mounted to two opposite sides of a front end of the first terminal module, the front ends of the two middle shielding plates and front ends of the two second terminal modules. The two opposite sides of the front end of the first terminal module and the front ends of the two second terminal modules are assembled to the assembling opening. The front ends of the middle shielding plates are fastened to the fastening slot. The front ends of the first terminals are fastened to the first terminal grooves and are exposed to the top surface of the tongue board. The front ends of the second terminals are fastened to the second terminal grooves and are exposed to the bottom surface of the tongue board. The shielding shell surrounds the first terminal module, the second terminal modules, the middle shielding plates and the docking modules.

As described above, the second base blocks of the two second terminal modules are respectively fastened to the bottom surfaces of the two flanks, each of the middle shielding plates is mounted between one of the flanks and the corresponding second base block, the two docking modules are mounted to the two opposite sides of a front end of the first terminal module, the front ends of the two middle shielding plates and the front ends of the two second terminal modules, and the two docking modules have two docking chambers, so the receptacle connector is assembled conveniently and is capable of interconnecting with two plug connectors. Simultaneously, when the receptacle connectors of the receptacle connector assembly are soldered to the circuit board, the receptacle connectors of the receptacle connector assembly will just occupy a smaller area of the circuit board on account of the receptacle connectors being stacked up and down and being fastened together, in addition, the receptacle connectors of the receptacle connector assembly just need be placed on the circuit board once for saving working hours. As a result, production efficiency is improved.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
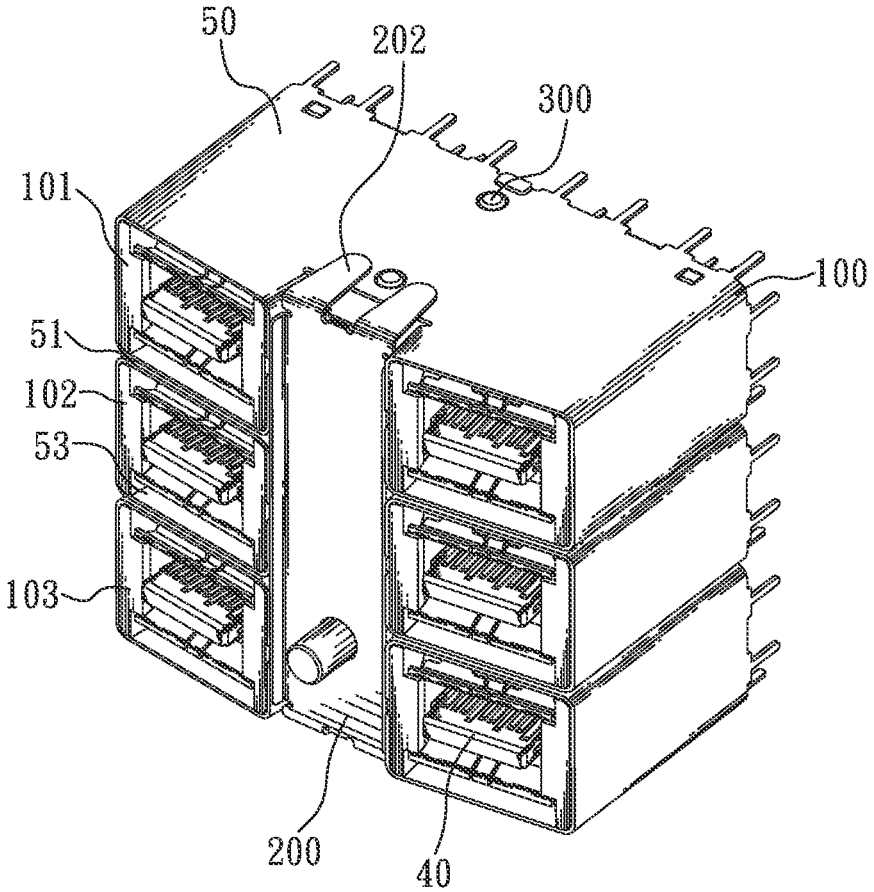
FIG. 1 is a perspective view of a receptacle connector assembly in accordance with the present invention.
Figure 2:
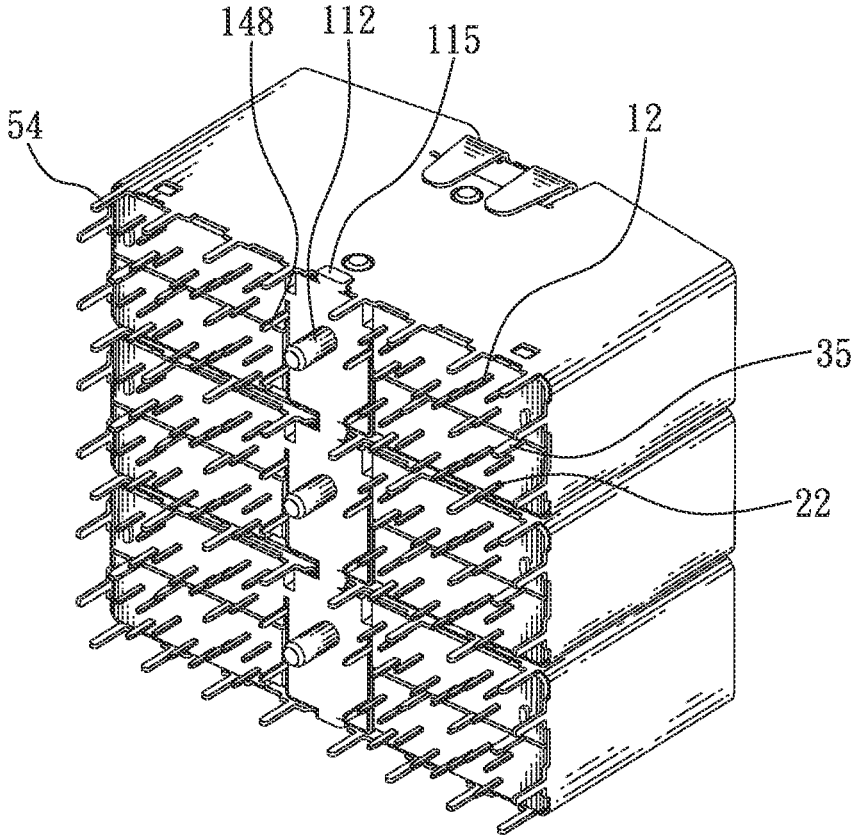
FIG. 2 is another perspective view of the receptacle connector assembly of FIG. 1.

With reference to FIG. 1, FIG. 3, FIG. 4 and FIG. 6, a receptacle connector 100 and a receptacle connector assembly in accordance with the present invention are shown. The receptacle connector 100 includes a first terminal module 10, two second terminal modules 20, two middle shielding plates 30, two docking modules 40 and a shielding shell 50. The receptacle connector assembly adapted for being soldered on a circuit board (not shown), includes a plurality of the receptacle connectors 100, a fastening piece 200 and two fastening pillars 300. The receptacle connectors 100 are stacked up and down and are fastened together.

Referring to FIG. 5 to FIG. 9, the first terminal module 10 includes a first base block 11, two groups of first terminals 12, an upper shell 13 and a lower shell 14. The first base block 11 has a rectangular first fastening portion 111. A rear surface of the first fastening portion 111 protrudes rearward to form a locating pillar 112. The first fastening portion 111 defines two first fastening holes 113 penetrating through a top surface and a bottom surface of the first fastening portion 111. The two first fastening holes 113 are longitudinally arranged. A substantial middle of the bottom surface of the first fastening portion 111 is concaved inward to form a first insertion slot 114. Rear ends of the top surface and the bottom surface of the first fastening portion 111 protrude outward to form two protruding blocks 115. Upper portions of rear ends of two side surfaces of the first fastening portion 111 protrude upward and outward to form two flanks 117. The two flanks 117 are symmetrical to each other with respect to the first fastening portion 111.

The first base block 11 defines two first narrow slots 118 penetrating through tops of inner sides of the two flanks 117, and two second narrow slots 119 penetrating through bottoms of the inner sides of the two flanks 117. The two second narrow slots 119 are respectively located under the two first narrow slots 118. The second narrow slot 119 and the first narrow slot 118 of each of the flanks 117 are isolated by an isolating wall 116. The isolating wall 116 defines a plurality of insertion holes 1161 penetrating through a top surface and a bottom surface of the isolating wall 116. The insertion holes 1161 are arranged longitudinally. Each of the flanks 117 has a first base portion 1173. Front surfaces of the first base portions 1173 of the two flanks 117 are inclined sideward. A lower portion of a substantial middle of the front surface of the first base portion 1173 protrudes frontward to form a locating portion 1171 with two opposite side surfaces of the locating portion 1171 being perpendicular to the front surface of the first base portion 1173. Several portions of a bottom surface of the first base portion 1173 of each of the flanks 117 protrude downward to form a plurality of propping portions 1172.

Figure 8:
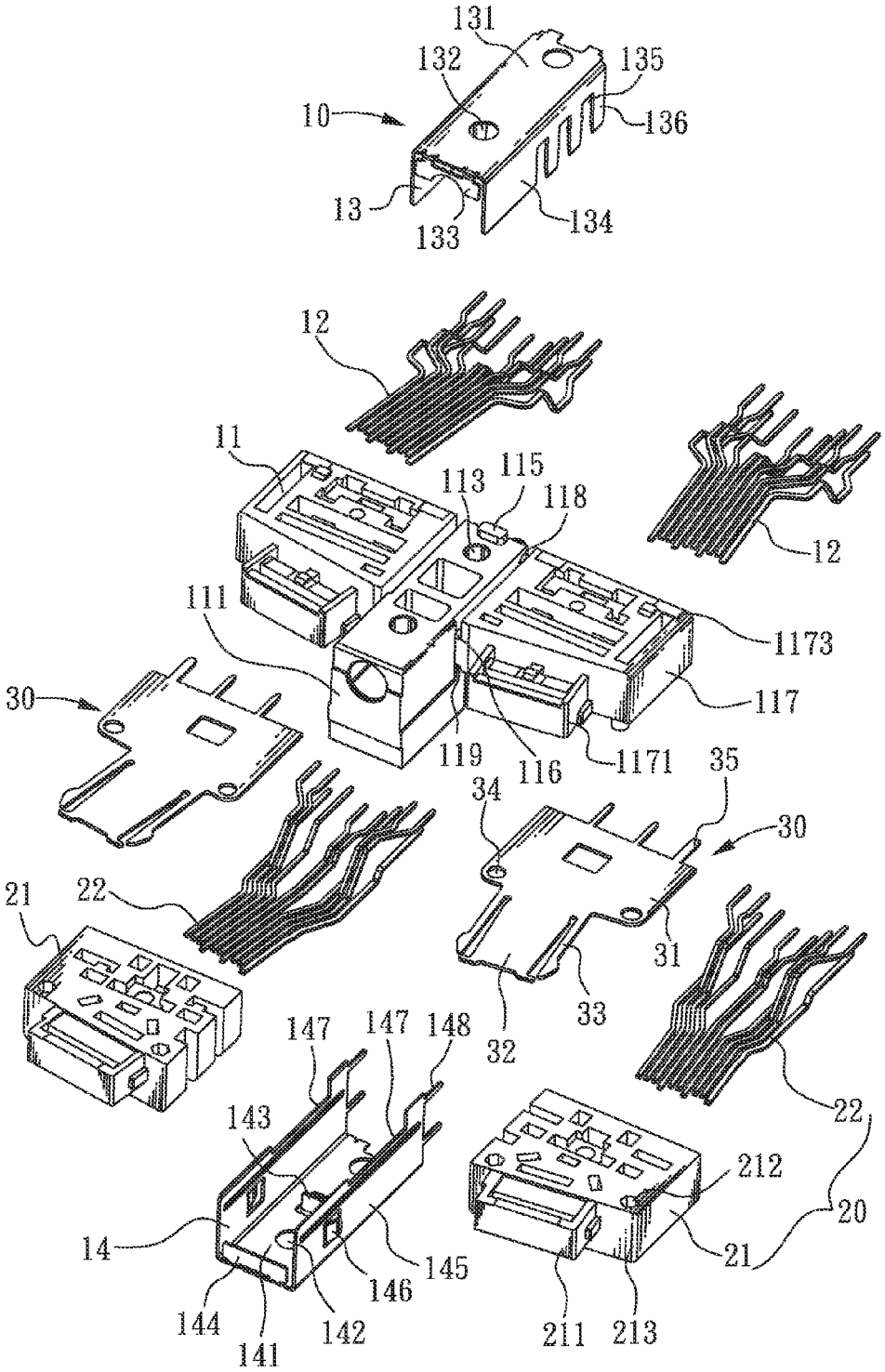
FIG. 8 is a partially exploded view of the receptacle connector of the receptacle connector assembly of FIG. 4.
Figure 9:
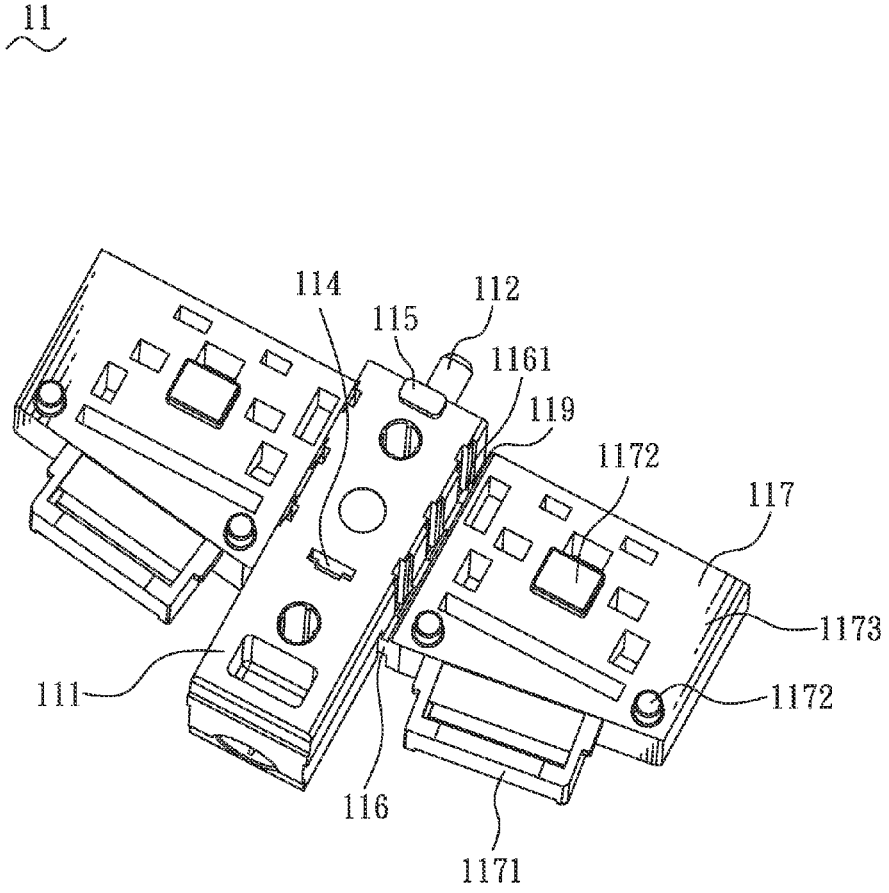
FIG. 9 is a perspective view of a first base block of the receptacle connector of the receptacle connector assembly of FIG. 4.

Referring to FIG. 8, the upper shell 13 has a first base plate 131, two first side plates 134 bent downward from two opposite sides of the first base plate 131, and a first front plate 133 perpendicularly connected with a front edge of the first base plate 131 and located between the two first side plates 134. The first base plate 131 defines two second fastening holes 132 arranged longitudinally. Rear ends of the two first side plates 134 define two notches 135 penetrating through bottom surfaces and rear surfaces of the rear ends of the two first side plates 134. Several portions of a top wall of each of the notches 135 extend downward to form a plurality of spaced first insertion slices 136.

Referring to FIG. 8, the lower shell 14 has a second base plate 141, two second side plates 145 extended upward from two opposite sides of the second base plate 141, and a second front plate 144 perpendicularly connected with a front edge of the second base plate 141 and located between the two second side plates 145. The second base plate 141 defines two third fastening holes 142 arranged longitudinally. A middle of the second base plate 141 is punched upward to form a second insertion slice 143 located between the two third fastening holes 142. Front ends of the two second side plates 145 are punched outward to form two elastic resisting portions 146. A top edge of each of the second side plates 145 is recessed downward to form a limiting groove 147. Two portions of a rear edge of each of the second side plates 145 extend rearward to form two first soldering slices 148 spaced from each other.

Figure 7:
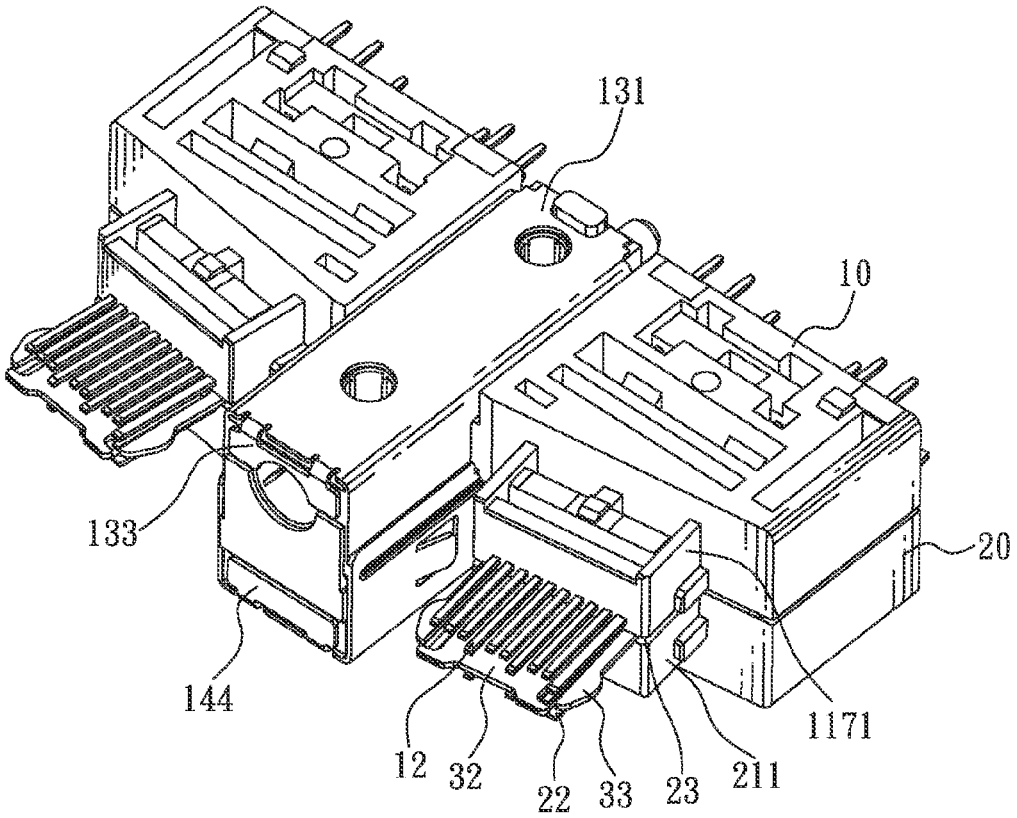
FIG. 7 is another partially perspective view of the receptacle connector of the receptacle connector assembly of FIG. 4.

Referring to FIG. 7 and FIG. 8, the two groups of the first terminals 12 are respectively fastened to the two flanks 117. Rear ends of the first terminals 12 project beyond rear surfaces of the two flanks 117. Front ends of the first terminals 12 project beyond front surfaces of the two flanks 117. Specifically, the front ends of the first terminals 12 project beyond front surfaces of the locating portions 1171 of the two flanks 117.

Figure 6:
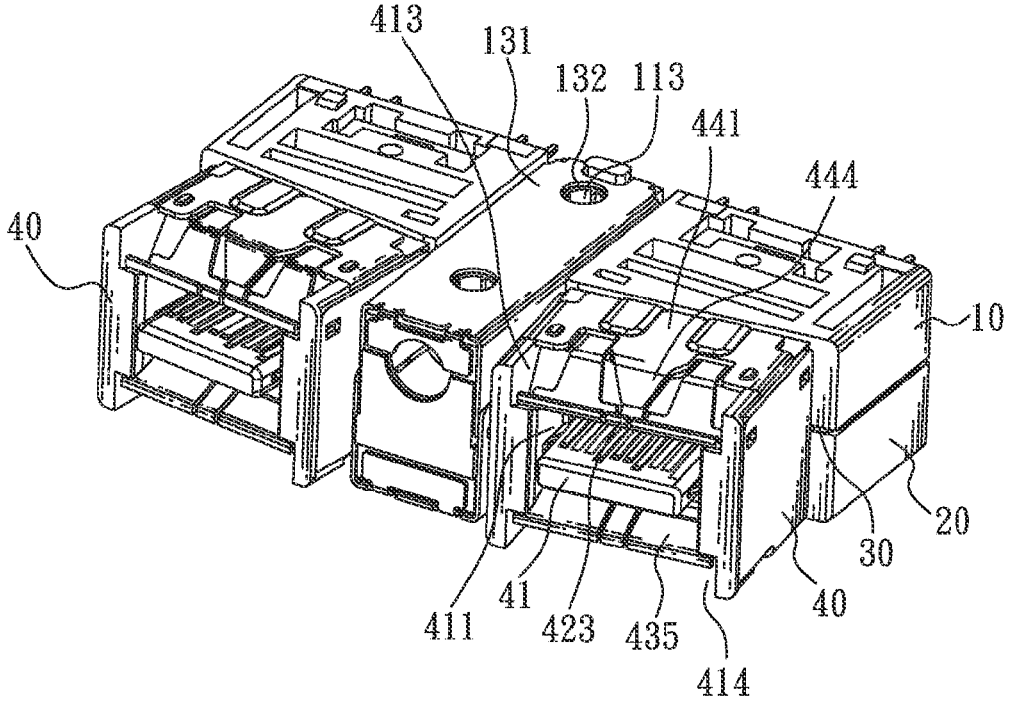
FIG. 6 is a partially perspective view of the receptacle connector of the receptacle connector assembly of FIG. 4.

Referring to FIG. 6, FIG. 7 and FIG. 8, the first base plate 131 of the upper shell 13 is disposed on the top surface of the first fastening portion 111. The first front plate 133 is fastened to an upper portion of a front surface of the first fastening portion 111. The two second fastening holes 132 are respectively corresponding to the two first fastening holes 113. The two first side plates 134 are respectively fastened to upper portions of the two side surfaces of the first fastening portion 111. Rear ends of the two first side plates 134 are inserted into the two first narrow slots 118. The first insertion slices 136 are inserted into the insertion holes 1161 through the first narrow slots 118.

Referring to FIG. 6 to FIG. 9, the second base plate 141 of the lower shell 14 is disposed to the bottom surface of the first fastening portion 111. The second front plate 144 is fastened to a lower portion of the front surface of the first fastening portion 111. The second insertion slice 143 is inserted into the first insertion slot 114. The two third fastening holes 142 are respectively corresponding to the two first fastening holes 113. The two second side plates 145 are respectively fastened to lower portions of the two side surfaces of the first fastening portion 111. Tops of rear ends of the two second side plates 145 are inserted into the two second narrow slots 119. A bottom of the isolating wall 116 is limited in the limiting groove 147. Inner surfaces of upper ends of the two second side plates 145 are attached to outer surfaces of lower ends of the two first side plates 134.

Referring to FIG. 8, the two second terminal modules 20 are symmetrical to each other. Each of the second terminal modules 20 has a rectangular second base block 21 and a group of second terminals 22. The second base block 21 has a second base portion 213. Front surfaces of the second base portions 213 of the two second terminal modules 20 are inclined sideward. An upper portion of a middle of the front surface of the second base portion 213 protrudes frontward to form a second fastening portion 211 with two opposite side surfaces of the second fastening portion 211 perpendicular to the front surface of the second base portion 213. The second base block 21 defines a plurality of locating holes 212 penetrating through a top surface of the second base portion 213.

The two groups of the second terminals 22 are respectively fastened to the two second base blocks 21. Rear ends of the second terminals 22 project beyond rear surfaces of the second base blocks 21. Front ends of the second terminals 22 project beyond front surfaces of the second base blocks 21. Specifically, the front ends of the second terminals 22 project beyond front surfaces of the second fastening portions 211 of the two second base blocks 21.

Referring to FIG. 8, each of the middle shielding plates 30 has a third base plate 31. Front surfaces of the third base plates 31 of the two middle shielding plates 30 are inclined sideward. A substantial middle of the front surface of the third base plate 31 protrudes frontward to form a fastening plate 32 with two opposite sides of the fastening plate 32 being perpendicular to the front surface of the third base plate 31. Two opposite sides of the front surface of the third base plate 31 extend frontward to form two elastic arms 33. The fastening plate 32 is located between the two elastic arms 33. Rear ends of the two elastic arms 33 are connected with rear ends of two opposite sides of the fastening plate 32. Front ends of the two elastic arms 33 are spaced from front ends of the two opposite sides of the fastening plate 32. A front end of the third base plate 31 defines two through-holes 34. Several portions of a rear edge of the third base plate 31 protrude rearward to form a plurality of second soldering slices 35 arranged transversely.

Referring to FIG. 5, FIG. 6, FIG. 10 and FIG. 11, each of the docking modules 40 includes a rectangular docking portion 41, an upper holding plate 42, a lower holding plate 43, a guiding plate 44 and two ground elements 45. The docking portion 41 defines a docking chamber 411 penetrating through a middle of a front surface of the docking portion 41. The docking portion 41 defines an assembling opening 418 penetrating through a middle of a rear surface of the docking portion 41. The docking chamber 411 and the assembling opening 418 are isolated by an isolating board 401. A middle of the isolating board 401 protrudes frontward to form a tongue board 412 projecting beyond the front surface of the docking portion 41. Front ends of a top surface and a bottom surface of the docking portion 41 are recessed inward to form a first lacking groove 413 and a second lacking groove 414. Middles of front ends of the first lacking groove 413 and the second lacking groove 414 are communicated with the docking chamber 411. Upper portions of middles of two opposite sides of the docking portion 41 are recessed inward to form two buckling grooves 403. Inner walls of the two buckling grooves 403 protrude outward to form two first buckling portions 404. Two opposite sides of the top surface of the docking portion 41 protrude upward to form two second buckling portions 405. A front and a rear of each side surface of the docking portion 41 protrude outward to form two third buckling portions 406.

Rear ends of the top surface and the bottom surface of the docking portion 41 are recessed inward to form a first recess 415 and a second recess 416. Two opposite sides of a rear end of a bottom wall of the first recess 415 is recessed inward to form two second insertion slots 4151. The docking portion 41 defines a fastening slot 417 longitudinally penetrating through a middle of the isolating board 401 and extending to a front of the tongue board 412, and further penetrating through two opposite side surfaces of the tongue board 412. The fastening slot 417 is communicated with the assembling opening 418.

The docking portion 41 defines a plurality of first terminal grooves 4121 arranged transversely, and a plurality of second terminal grooves 4122 arranged transversely and located under the first terminal grooves 4121. Each of the first terminal grooves 4121 penetrates through an upper portion of the isolating board 401 and a top surface of the tongue board 412. Each of the second terminal grooves 4122 penetrates through a lower portion of the isolating board 401 and a bottom surface of the tongue board 412. The first terminal grooves 4121 and the second terminal grooves 4122 are communicated with the assembling opening 418. Middles of two opposite sides of the docking portion 41 are recessed inward to form two fixing slots 419. An inner wall of each of the fixing slots 419 defines a perforation 4191 communicated between the fixing slot 419 and the docking chamber 411. A middle of each of the fixing slots 419 extends downward to form a locating groove 402.

Figure 10:
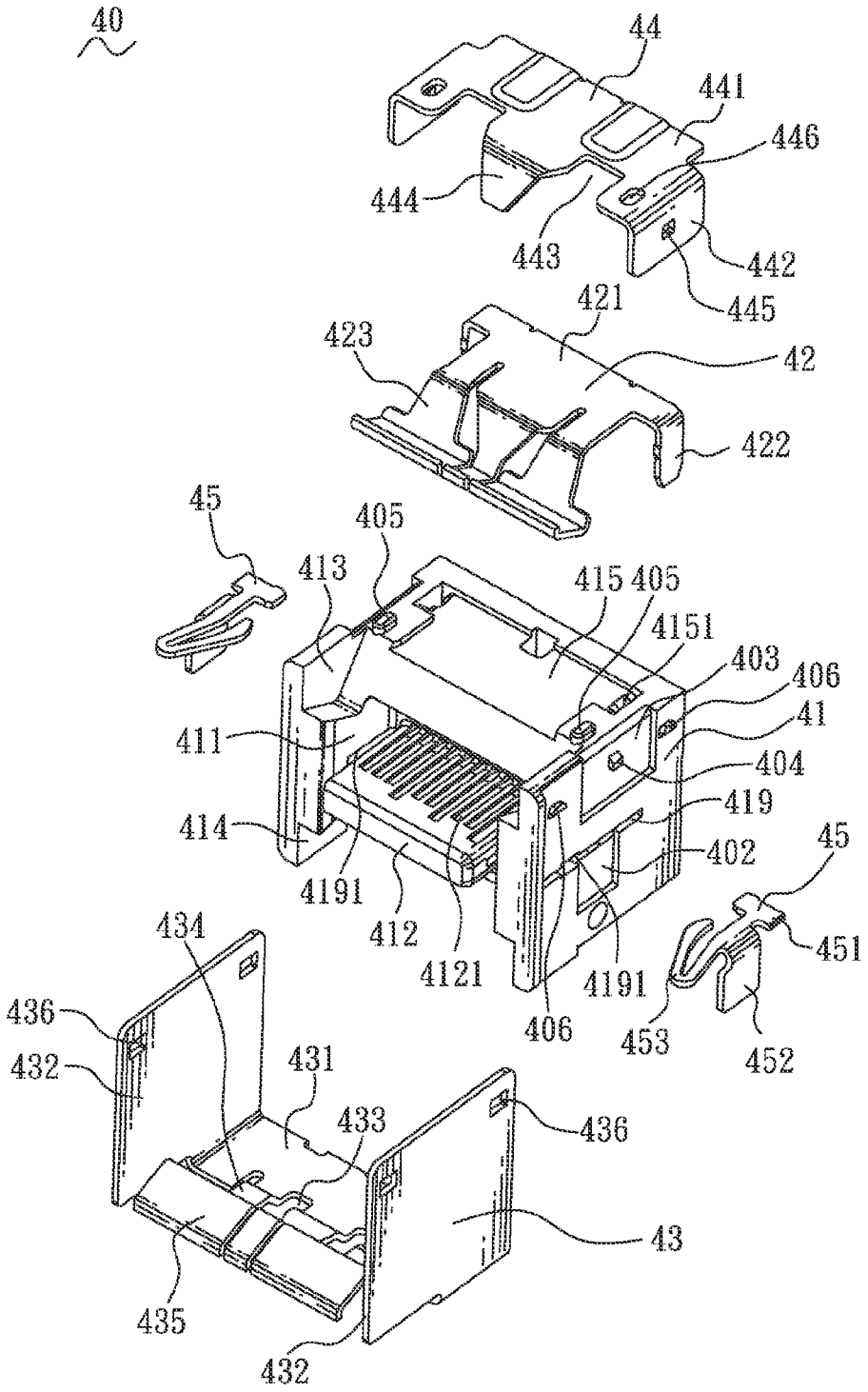
FIG. 10 is an exploded view of a docking module of the receptacle connector of the receptacle connector assembly of FIG. 4.
Figure 11:
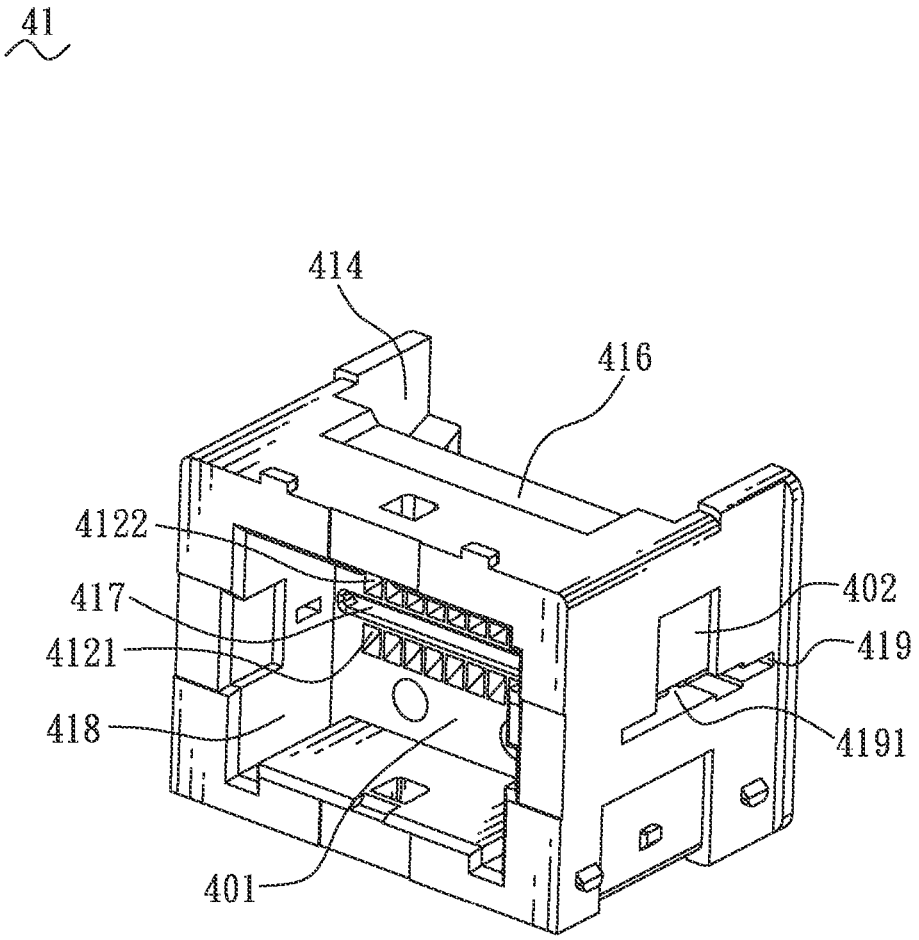
FIG. 11 is a perspective view of a docking portion of the docking module of the receptacle connector of the receptacle connector assembly of FIG. 10.
Figure 12:
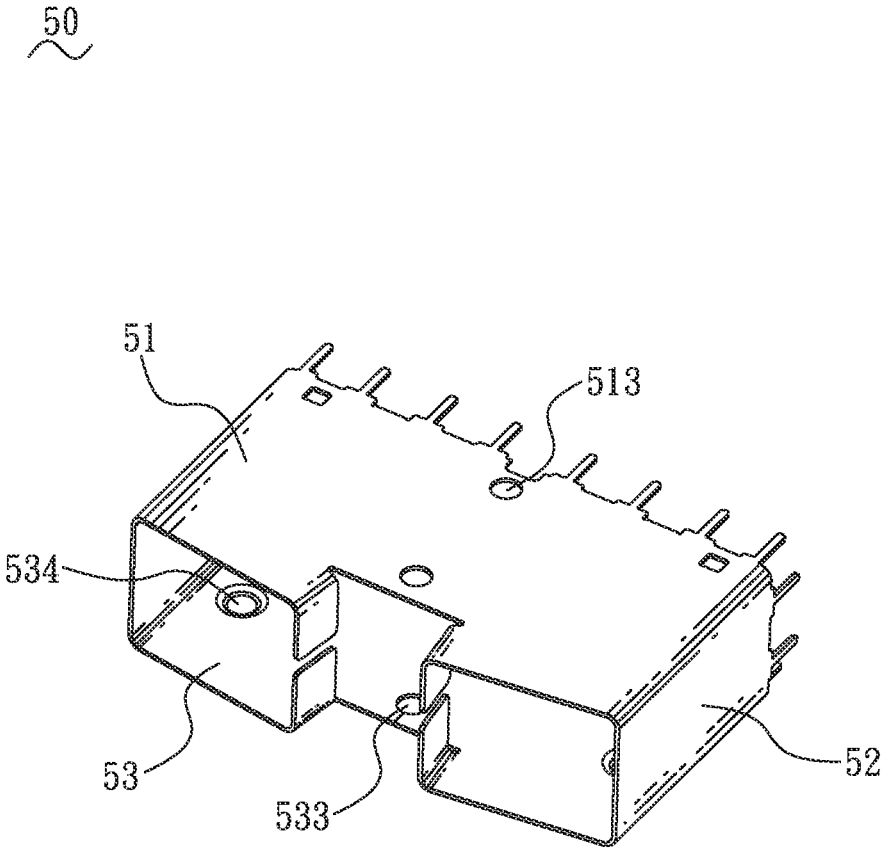
FIG. 12 is a perspective view of a first shielding shell of a first receptacle connector of the receptacle connector assembly of FIG. 1.
Figure 13:
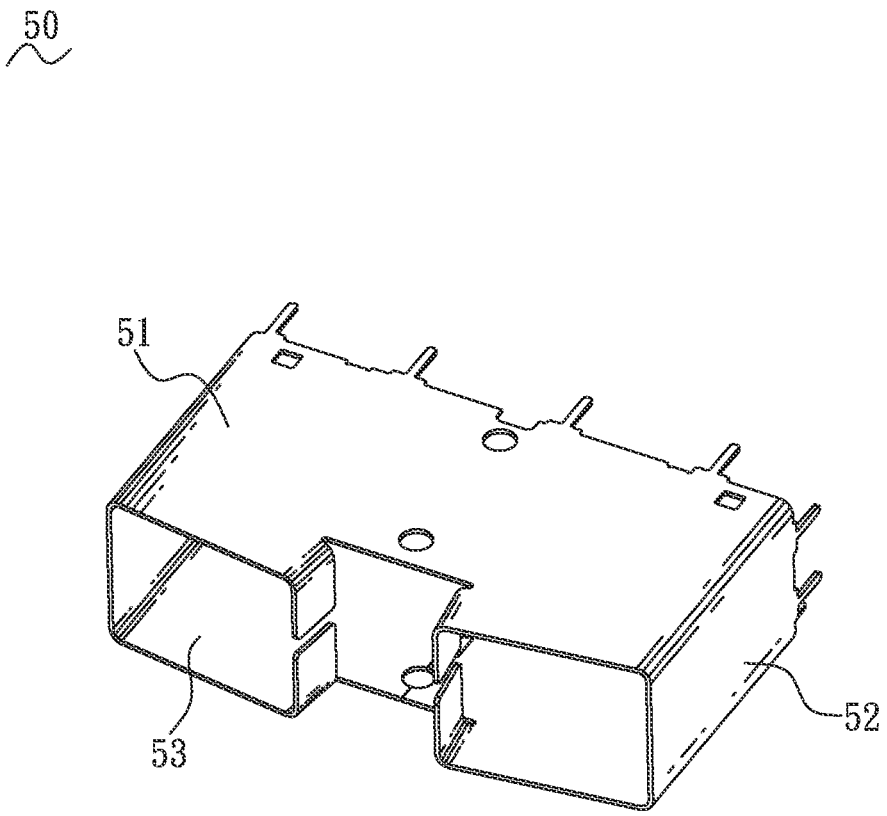
FIG. 13 is a perspective view of a second shielding shell of a second receptacle connector of the receptacle connector assembly of FIG. 1.
Figure 14:
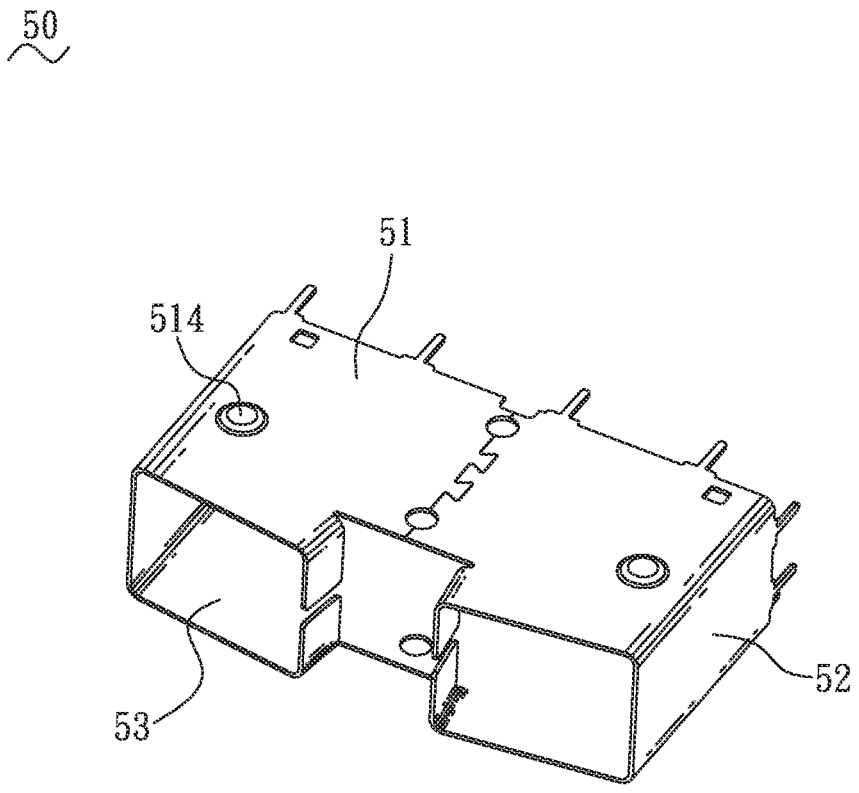
FIG. 14 is a perspective view of a third shielding shell of a third receptacle connector of the receptacle connector assembly of FIG. 1.

Referring to FIG. 10, the upper holding plate 42 has a rectangular first locating plate 421. Rears of two opposite sides of the first locating plate 421 extend oppositely and then are bent downward to form two third insertion slices 422. A front edge of the first locating plate 421 extends frontward, then is arched downward and further protrudes upward to form a first resilient portion 423. Specifically, three portions of the first locating plate 421 extend frontward, then arch downward and further protrude upward to form three spaced first resilient portions 423.

Referring to FIG. 10, the lower holding plate 43 has a second locating plate 431. Two opposite sides of the second locating plate 431 are bent upward and then extend frontward to form two third side plates 432 projecting beyond a front edge of the second locating plate 431. The second locating plate 431 defines a first mouth 433 penetrating through a middle of the front edge of the second locating plate 431. A rear wall of the first mouth 433 meanders frontward to form a second connecting portion 434. A free end of the second connecting portion 434 is arched upward and then extends downward to form a second resilient portion 435. Specifically, several portions of the rear wall of the first mouth 433 meanders frontward to form a plurality of second connecting portions 434. A free end of each of the second connecting portions 434 is arched upward and then extends downward to form the second resilient portion 435. A front and a rear of each of the third side plates 432 define two third buckling holes 436.

Referring to FIG. 10, the guiding plate 44 has a rectangular third locating plate 441. Two opposite sides of the third locating plate 441 are bent downward to form two fourth side plates 442. The third locating plate 441 defines a second mouth 443 penetrating through a middle of a front surface of the third locating plate 441. A middle of a rear wall of the second mouth 443 extends frontward, and then is inclined frontward and downward to form a blocking piece 444. The two fourth side plates 442 define two first buckling holes 445. Two opposite sides of the third locating plate 441 define two second buckling holes 446.

The two ground elements 45 are disposed symmetrically. The two ground elements 45 have two T-shaped fixing portions 451 disposed horizontally and spaced from each other. Outer sides of the two fixing portions 451 are bent downward to form two soldering pieces 452. Middles of front edges of the two fixing portions 451 slantwise extend outward and frontward, and then are curved rearward to form two elastic contact portions 453 with tail ends of the two elastic contact portions 453 facing to and spaced from inner sides of the two fixing portions 451.

The two fixing portions 451 are respectively fastened to the two opposite sides of the docking portion 41. The two elastic contact portions 453 project into the docking chamber 411 through the two opposite sides of the docking portion 41. Specifically, the two fixing portions 451 are respectively fixed in the two fixing slots 419. The two soldering pieces 452 are located in the locating grooves 402. The two elastic contact portions 453 respectively pass through the two perforations 4191 to be inserted into the docking chamber 411. The first locating plate 421 is located in the first recess 415. The two third insertion slices 422 are inserted into the two second insertion slots 4151. The first resilient portion 423 is disposed in the first lacking groove 413.

The third locating plate 441 is disposed on a top surface of the first locating plate 421. The two fourth side plates 442 are respectively buckled in the two buckling grooves 403. The first buckling portions 404 are buckled in the first buckling holes 445. The two second buckling portions 405 are buckled in the two second buckling holes 446. The blocking piece 444 is disposed on a rear end of the first resilient portion 423. The second locating plate 431 is disposed to a bottom surface of the docking portion 41. The two third side plates 432 are respectively fastened to the two opposite sides of the docking portion 41. The two third buckling portions 406 are buckled in the third buckling holes 436. Lower portions of inner surfaces of the two third side plates 432 abut against outer surfaces of the two soldering pieces 452. Upper portions of inner surfaces of the two third side plates 432 abut against outer surfaces of the two fourth side plates 442. The second connecting portion 434 is disposed in the second recess 416. The second resilient portion 435 is disposed in the second lacking groove 414.

Figure 4:
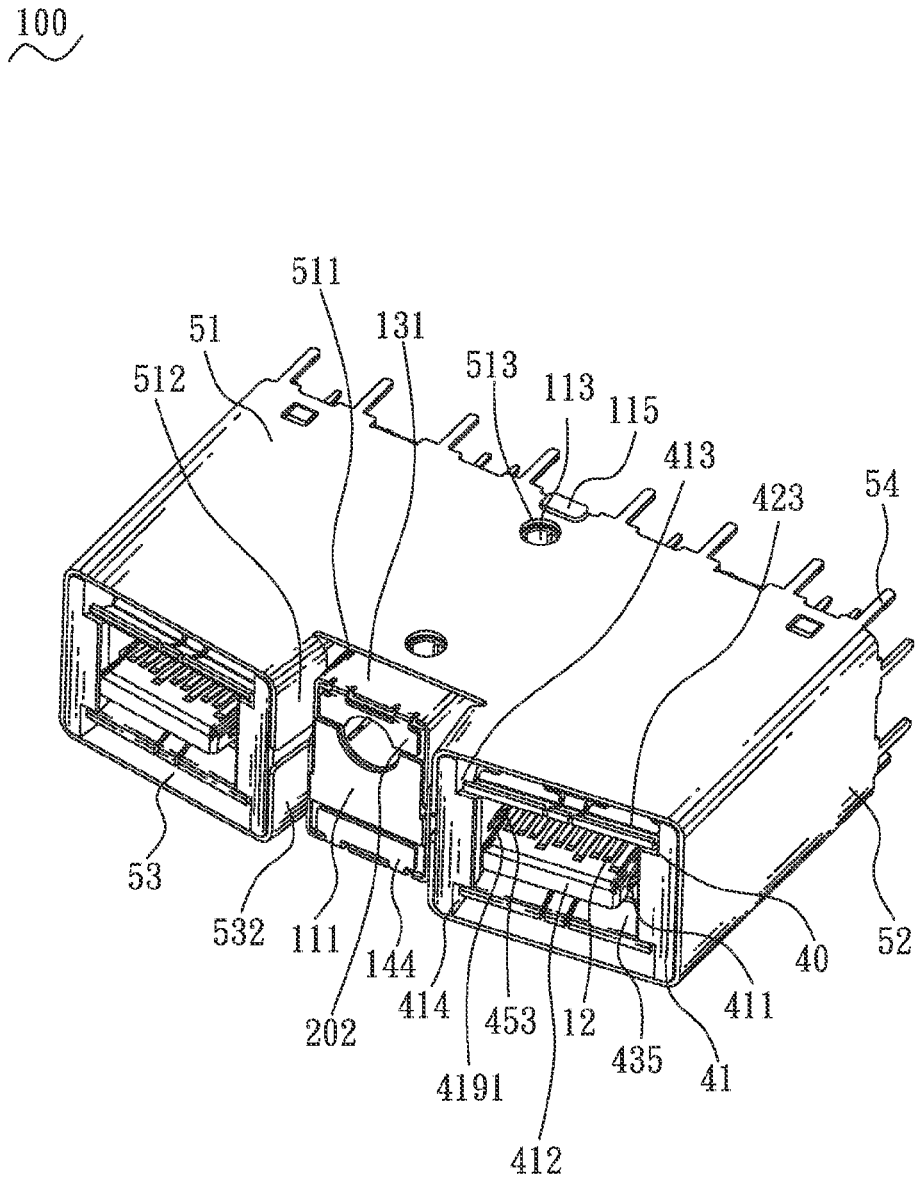
FIG. 4 is a perspective view of a receptacle connector of the receptacle connector assembly of FIG. 1.
Figure 5:
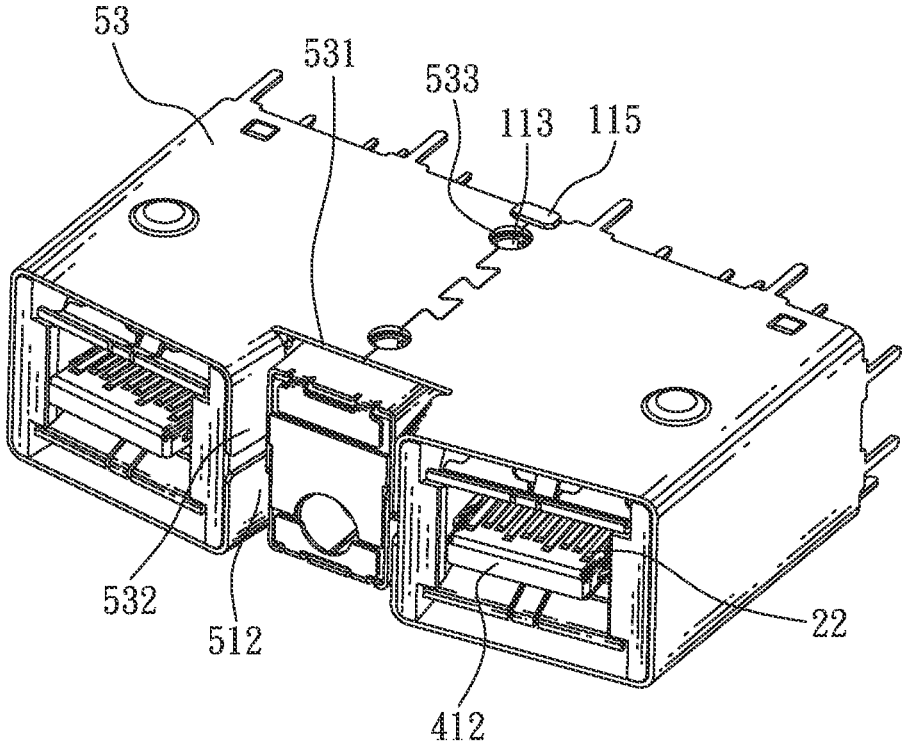
FIG. 5 is another perspective view of the receptacle connector of the receptacle connector assembly of FIG. 4.

Referring to FIG. 4 and FIG. 5, the shielding shell 50 has a top plate 51, two lateral plates 52 extended downward from two opposite sides of the top plate 51, and a bottom plate 53 connected between bottoms of the two lateral plates 52. A middle of a front edge of the top plate 51 is recessed inward to form a first gap 511. Two opposite walls of the first gap 511 are bent downward to form two first blocking arms 512. A middle of a front edge of the bottom plate 53 is recessed inward to form a second gap 531 facing to the first gap 511. Two opposite walls of the second gap 531 are bent downward to form two second blocking arms 532. The top plate 51 of the shielding shell 50 defines two fourth fastening holes 513 arranged longitudinally. The two fourth fastening holes 513 are respectively corresponding to the two first fastening holes 113. The bottom plate 53 of the shielding shell 50 defines two fifth fastening holes 533 arranged longitudinally. The two fifth fastening holes 533 are respectively corresponding to the two first fastening holes 113. Several portions of rear edges of the top plate 51, the two lateral plates 52 and the bottom plate 53 extend rearward to form a plurality of third soldering slices 54.

Figure 3:
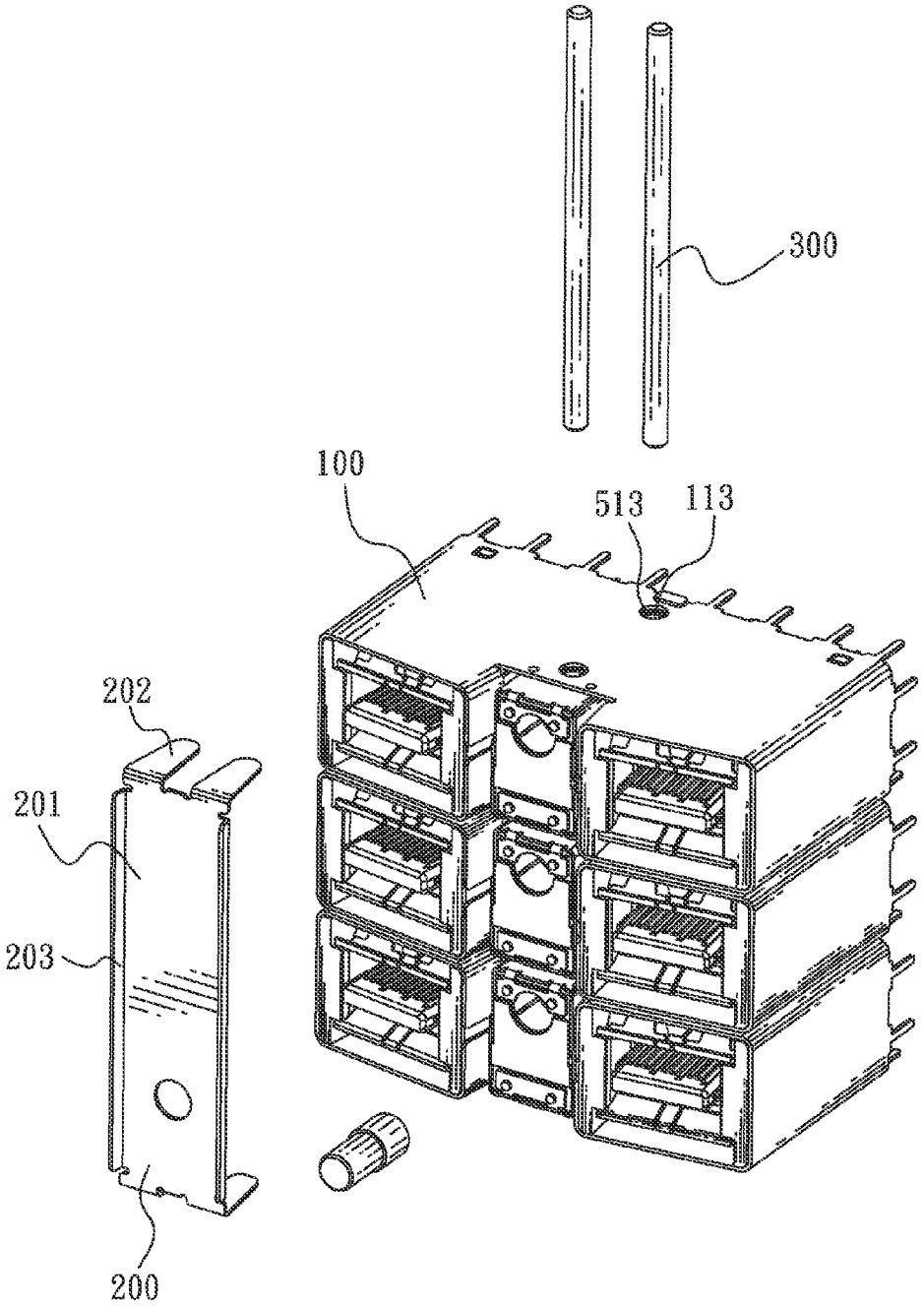
FIG. 3 is an exploded view of the receptacle connector assembly of FIG. 1.

Referring to FIG. 3, the fastening piece 200 has a restricting plate 201 disposed vertically. Two portions of the top edge of the restricting plate 201 are bent rearward to form two clamping plates 202. Two portions of the bottom edge of the restricting plate 201 are bent rearward to form another two clamping plates 202. Two opposite sides of the restricting plate 201 are bent frontward to form two blocking plates 203.

Referring to FIG. 3 to FIG. 11, when the receptacle connector 100 is assembled, at first, the two middle shielding plates 30 are respectively fastened to bottom surfaces of the two flanks 117 of the first terminal module 10. The two second terminal modules 20 are respectively fastened to bottom surfaces of the two middle shielding plates 30. Specifically, the second base blocks 21 of the two second terminal modules 20 are respectively fastened to the bottom surfaces of the two flanks 117. The front surface of the second base portion 213 is flush with the front surface of the first base portion 1173. The two locating portions 1171 are respectively corresponding to the two second fastening portions 211. The propping portions 1172 are respectively fastened on top surfaces of the two second base portions 213 of the second base block 21. The two flanks 117 are respectively spaced from the top surfaces of the two second base portions 213 of the second base block 21 to form two clamping slots 23. Each of the clamping slots 23 is located between one of the flanks 117 and the second base block 21. The two middle shielding plates 30 are respectively clamped in the two clamping slots 23. So each of the middle shielding plates 30 is mounted between one of the flanks 117 and the corresponding second base block 21. Front ends of the middle shielding plates 30 project beyond the front surfaces of the flanks 117 and the second base blocks 21.

The third base plate 31 of each of the middle shielding plates 30 is disposed between one of the flanks 117 and the corresponding second base block 21. The propping portions 1172 pass through the through-holes 34 to be located in the locating holes 212. The front surfaces of the first base portions 1173 of the two flanks 117 are respectively flush with the front surfaces of the second base portions 213 of the two second terminal modules 20. The front surfaces of the third base plates 31 are respectively flush with the front surfaces of the first base portions 1173 of the two flanks 117, and the front surfaces of the third base plates 31 are respectively flush with the front surfaces of the second base portions 213 of the two second terminal modules 20. Rear ends of the fastening plate 32 and the elastic arms 33 of each of the middle shielding plates 30 are clamped between the locating portion 1171 of one of the flanks 117 and the corresponding second fastening portion 211. Front ends of the fastening plate 32 and the elastic arms 33 of each of the middle shielding plates 30 project beyond the front surfaces of the locating portion 1171 of one of the flanks 117 and the corresponding second fastening portion 211. The second soldering slices 35 project beyond the rear surfaces of the flanks 117 and the second base blocks 21.

Then the two docking modules 40 are mounted to two opposite sides of a front end of the first terminal module 10, the front ends of the two middle shielding plates 30 and front ends of the two second terminal modules 20. Front ends of the two docking modules 40 respectively project beyond the front surface of the first fastening portion 111. The two opposite sides of the front end of the first terminal module 10 and the front ends of the two second terminal modules 20 are assembled to the assembling opening 418. The front ends of the two middle shielding plates 30 are fastened to the fastening slot 417. The front ends of the first terminals 12 are fastened to the first terminal grooves 4121 and are exposed to the top surface of the tongue board 412. The front ends of the second terminals 22 are fastened to the second terminal grooves 4122 and are exposed to the bottom surface of the tongue board 412. Specifically, the locating portion 1171 of one of the flanks 117 and the second fastening portion 211 are assembled in the assembling opening 418. Front ends of the fastening plate 32 and the elastic arms 33 of each of the middle shielding plates 30 are received in the fastening slot 417. The two elastic arms 33 of each of the middle shielding plates 30 project into the docking chamber 411 through the two opposite side surfaces of the tongue board 412. The two docking modules 40 of the receptacle connector 100 have two docking chambers 411, so the receptacle connector 100 is capable of interconnecting with two plug connectors (not shown).

At last, the shielding shell 50 surrounds the first terminal module 10, the two second terminal modules 20, the two middle shielding plates 30 and the two docking modules 40. The two first blocking arms 512 are respectively fastened to upper portions of two facing surfaces of the two lower holding plates 43 of the two docking modules 40. The two second blocking arms 532 are respectively fastened to lower portions of the two facing surfaces of the two lower holding plates 43 of the two docking modules 40. The two resisting portions 146 respectively abut against two facing surfaces of the two third side plates 432. The fourth fastening hole 513 is corresponding to the second fastening hole 132, the first fastening hole 113, the third fastening hole 142 and the fifth fastening hole 533.

Referring to FIG. 1, FIG. 2, FIG. 3, FIG. 12 and FIG. 14, preferably, the receptacle connectors 100 of the receptacle connector assembly include a first receptacle connector 101, a second receptacle connector 102 and a third receptacle connector 103. The first receptacle connector 101, the second receptacle connector 102 and the third receptacle connector 103 are stacked up and down and are fastened together. Two opposite sides of the bottom plate 53 of the shielding shell 50 of the first receptacle connector 101 protrude downward to form two lower protruding pillars 534. Two opposite sides of the top plate 51 of the shielding shell 50 of the third receptacle connector 103 protrude upward to form two upper protruding pillars 514.

Referring to FIG. 1 to FIG. 14, when the receptacle connector assembly is assembled, two facing protruding blocks 115 of two adjacent receptacle connectors 100 abut against each other. Specifically, the first receptacle connector 101 is stacked on the second receptacle connector 102. The protruding block 115 of the bottom surface of the first fastening portion 111 of the first receptacle connector 101 abuts against the protruding block 115 of the top surface of the first fastening portion 111 of the second receptacle connector 102. The two lower protruding pillars 534 of the shielding shell 50 of the first receptacle connector 101 abut against the top plate 51 of the shielding shell 50 of the second receptacle connector 102. So that the first receptacle connector 101 is stably stacked on the second receptacle connector 102.

The second receptacle connector 102 together with the first receptacle connector 101 is stacked on the third receptacle connector 103. The protruding block 115 of the bottom surface of the first fastening portion 111 of the second receptacle connector 102 abuts against the protruding block 115 of the top surface of the first fastening portion 111 of the third receptacle connector 103. The upper protruding pillars 514 of the shielding shell 50 of the third receptacle connector 103 abut against the bottom plate 53 of the shielding shell 50 of the second receptacle connector 102. So that the second receptacle connector 102 together with the first receptacle connector 101 is stably stacked on the third receptacle connector 103.

Each of the fastening pillars 300 is fastened in the fourth fastening hole 513, the second fastening hole 132, the first fastening hole 113, the third fastening hole 142 and the fifth fastening hole 533 of each of the receptacle connectors 100 for limiting horizontal movements of the receptacle connectors 100. The restricting plate 201 is disposed to the front surfaces of the first fastening portions 111 of the receptacle connectors 100. The clamping plates 202 are respectively soldered to the top plate 51 of the shielding shell 50 of the receptacle connector 100 located at a top of the receptacle connector assembly and the bottom plate 53 of the shielding shell 50 of the receptacle connector 100 located at a bottom of the receptacle connector assembly. The clamping plates 202 are respectively soldered to the top plate 51 of the shielding shell 50 of the first receptacle connector 101 and the bottom plate 53 of the shielding shell 50 of the third receptacle connector 103. The two blocking plates 203 of the fastening piece 200 are soldered to the first blocking arms 512 and the second blocking arms 532 of the shielding shells 50 of the receptacle connectors 100 for fastening the receptacle connectors 100 together and limiting vertical movements of the receptacle connectors 100. The locating pillars 112, the first soldering slices 148, the second soldering slices 35, the third soldering slices 54, the rear ends of the first terminals 12 and the rear ends of the second terminals 22 of the receptacle connectors 100 are inserted into and soldered to the circuit board for mounting the receptacle connector assembly to the circuit board.

As described above, the second base blocks 21 of the two second terminal modules 20 are respectively fastened to the bottom surfaces of the two flanks 117, each of the middle shielding plates 30 is mounted between one of the flanks 117 and the corresponding second base block 21, the two docking modules 40 are mounted to the two opposite sides of a front end of the first terminal module 10, the front ends of the two middle shielding plates 30 and the front ends of the two second terminal modules 20, and the two docking modules 40 have two docking chambers 411, so the receptacle connector 100 is assembled conveniently and is capable of interconnecting with the two plug connectors. Simultaneously, when the receptacle connectors 100 of the receptacle connector assembly are soldered to the circuit board, the receptacle connectors 100 of the receptacle connector assembly will just occupy a smaller area of the circuit board on account of the receptacle connectors 100 being stacked up and down and being fastened together, in addition, the receptacle connectors 100 of the receptacle connector assembly just need be placed on the circuit board once for saving working hours. As a result, production efficiency is improved.

What is claimed is:

1. A receptacle connector, comprising:

a first terminal module including a first base block and two groups of first terminals, the first base block having a first fastening portion, upper portions of rear ends of two side surfaces of the first fastening portion protruding upward and outward to form two flanks, the two groups of the first terminals respectively fastened to the two flanks, rear ends of the first terminals projecting beyond rear surfaces of the two flanks, front ends of the first terminals projecting beyond front surfaces of the two flanks;

two second terminal modules of which each has a second base block and a group of second terminals, the second base blocks of the two second terminal modules being respectively fastened to bottom surfaces of the two flanks, the two groups of the second terminals being respectively fastened to the two second base blocks, rear ends of the second terminals projecting beyond rear surfaces of the second base blocks, front ends of the second terminals projecting beyond front surfaces of the second base blocks;

two middle shielding plates of which each is mounted between one of the flanks and the corresponding second base block, front ends of the middle shielding plates projecting beyond the front surfaces of the flanks and the second base blocks;

two docking modules of which each includes a docking portion, the docking portion defining a docking chamber penetrating through a front surface of the docking portion, the docking portion defining an assembling opening penetrating through a rear surface of the docking portion, the docking chamber and the assembling opening being isolated by an isolating board, a middle of the isolating board protruding frontward to form a tongue board, the docking portion defining a fastening slot longitudinally penetrating through a middle of the isolating board and extending to a front of the tongue board, and further penetrating through two opposite side surfaces of the tongue board, the docking portion defining a plurality of first terminal grooves penetrating through an upper portion of the isolating board and a top surface of the tongue board, and a plurality of second terminal grooves penetrating through a lower portion of the isolating board and a bottom surface of the tongue board, the two docking modules being mounted to two opposite sides of a front end of the first terminal module, the front ends of the two middle shielding plates and front ends of the two second terminal modules, the two opposite sides of the front end of the first terminal module and the front ends of the two second terminal modules being assembled to the assembling opening, the front ends of the middle shielding plates being fastened to the fastening slot, the front ends of the first terminals being fastened to the first terminal grooves and being exposed to the top surface of the tongue board, the front ends of the second terminals being fastened to the second terminal grooves and being exposed to the bottom surface of the tongue board; and a shielding shell surrounding the first terminal module, the second terminal modules, the middle shielding plates and the docking modules;

wherein each of the docking modules includes two ground elements disposed symmetrically, the two ground elements have two fixing portions, outer sides of the two fixing portions are bent downward to form two soldering pieces, middles of front edges of the two fixing portions slantwise extend outward and frontward, and then are curved rearward to form two elastic contact portions with tail ends of the two elastic contact portions facing to and spaced from two inner sides of the two fixing portions, middles of two opposite sides of the docking portion are recessed inward to form two fixing slots, a middle of each of the fixing slots extends downward to form a locating groove, an inner wall of each of the fixing slots defines a perforation communicated with the fixing slot and the docking chamber, the two fixing portions are respectively fixed in the two fixing slots, the two elastic contact portions respectively pass through the two perforations to be inserted into the docking chamber, the two soldering pieces are located in the locating grooves.

2. The receptacle connector as claimed in claim 1, wherein each of the flanks has a first base portion, a lower portion of a substantial middle of a front surface of the first base portion protrudes frontward to form a locating portion, the second base block has a second base portion, a middle of a front surface of the second base portion protrudes frontward to form a second fastening portion, the front ends of the first terminals project beyond front surfaces of the locating portions of the two flanks, the front ends of the second terminals project beyond front surfaces of the second fastening portions of the two second base blocks.

3. The receptacle connector as claimed in claim 2, wherein each of the middle shielding plates has a third base plate, a substantial middle of a front surface of the third base plate protrudes frontward to form a fastening plate, two opposite sides of the front surface of the third base plate extend frontward to form two elastic arms, the third base plate of each of the middle shielding plates is disposed between one of the flanks and the corresponding second base block, the two locating portions are respectively corresponding to the two second fastening portions, rear ends of the fastening plate and the elastic arms of each of the middle shielding plates are clamped between the locating portion of one of the flanks and the corresponding second fastening portion, front ends of the fastening plate and the elastic arms of each of the middle shielding plates project beyond the front surfaces of the locating portion of one of the flanks and the corresponding second fastening portion, the locating portion of one of the flanks and the corresponding second fastening portion are assembled in the assembling opening, the two elastic arms of each of the middle shielding plates project into the docking chamber through the two opposite side surfaces of the tongue board.

4. The receptacle connector as claimed in claim 3, wherein the two flanks are symmetrical to each other with respect to the first fastening portion, the front surfaces of the first base portions of the two flanks are inclined sideward, the two second terminal modules are symmetrical to each other, the front surfaces of the second base portions of the two second terminal modules are inclined sideward, the front surfaces of the third base plates of the two middle shielding plates are inclined sideward, the front surfaces of the first base portions of the two flanks are respectively flush with the front surfaces of the second base portions of the two second terminal modules, the front surfaces of the third base plates are respectively flush with the front surfaces of the first base portions of the two flanks, and the front surfaces of the third base plates are respectively flush with the front surfaces of the second base portions of the two second terminal modules.

5. The receptacle connector as claimed in claim 2, wherein front ends of a top surface and a bottom surface of the docking portion are recessed inward to form a first lacking groove and a second lacking groove, front ends of the first lacking groove and the second lacking groove are communicated with the docking chamber, rear ends of the top surface and the bottom surface of the docking portion are recessed inward to form a first recess and a second recess, each of the docking modules includes an upper holding plate and a lower holding plate, the upper holding plate has a first locating plate, a front edge of the first locating plate extends frontward, then is arched downward and further protrudes upward to form a first resilient portion, the lower holding plate has a second locating plate, the second locating plate defines a first mouth penetrating through a middle of a front edge of the second locating plate, a rear wall of the first mouth meanders frontward to form a second connecting portion, a free end of the second connecting portion is arched upward and then extends downward to form a second resilient portion, the first locating plate is located in the first recess, the first resilient portion is disposed in the first lacking groove, the second locating plate is disposed to the bottom surface of the docking portion, the second connecting portion is disposed in the second recess, the second resilient portion is disposed in the second lacking groove.

6. The receptacle connector as claimed in claim 5, wherein two opposite sides of the second locating plate are bent upward and then extend frontward to form two third side plates projecting beyond the front edge of the second locating plate, each of the docking modules further includes a guiding plate, the guiding plate has a third locating plate, two opposite sides of the third locating plate are bent downward to form two fourth side plates, the third locating plate defines a second mouth penetrating through a middle of a front surface of the third locating plate, a rear wall of the second mouth extends frontward, and then is inclined frontward and downward to form a blocking piece, the third locating plate is disposed on a top surface of the first locating plate, upper portions of inner surfaces of the two third side plates abut against outer surfaces of the two fourth side plates, the blocking piece is disposed on a rear end of the first resilient portion.

7. The receptacle connector as claimed in claim 1, wherein the first terminal module further includes an upper shell, the upper shell has a first base plate, two first side plates bent downward from two opposite sides of the first base plate, and a first front plate perpendicularly connected with a front edge of the first base plate and located between the two first side plates, rear ends of the two first side plates define two notches penetrating through bottom surfaces and rear surfaces of the rear ends of the two first side plates, several portions of a top wall of each of the notches extend downward to form a plurality of first insertion slices, the first base block defines two first narrow slots penetrating through tops of inner sides of the two flanks, and two second narrow slots penetrating through bottoms of the inner sides of the two flanks, the second narrow slot and the first narrow slot of each of the flanks are isolated by an isolating wall, the isolating wall defines a plurality of insertion holes penetrating through a top surface and a bottom surface of the isolating wall and arranged longitudinally, the first base plate is disposed on a top surface of the first fastening portion, the first front plate is fastened to an upper portion of a front surface of the first fastening portion, the two first side plates are respectively fastened to upper portions of the two side surfaces of the first fastening portion, rear ends of the two first side plates are inserted into the two first narrow slots, the first insertion slices are inserted into the insertion holes through the first narrow slots.

8. The receptacle connector as claimed in claim 7, wherein the first terminal module further includes a lower shell, the lower shell has a second base plate, two second side plates extended upward from two opposite sides of the second base plate, and a second front plate perpendicularly connected with a front edge of the second base plate and located between the two second side plates, a top edge of each of the second side plates is recessed downward to form a limiting groove, the second base plate of the lower shell is disposed to a bottom surface of the first fastening portion, the second front plate is fastened to a lower portion of the front surface of the first fastening portion, the two second side plates are respectively fastened to lower portions of the two side surfaces of the first fastening portion, tops of rear ends of the two second side plates are inserted into the two second narrow slots, a bottom of the isolating wall is limited in the limiting groove, inner surfaces of upper ends of the two second side plates are attached to outer surfaces of lower ends of the two first side plates.

9. The receptacle connector as claimed in claim 8, wherein the shielding shell has a top plate, two lateral plates extended downward from two opposite sides of the top plate, and a bottom plate connected between bottoms of the two lateral plates, a middle of a front edge of the top plate is recessed inward to form a first gap, two opposite walls of the first gap are bent downward to form two first blocking arms, a middle of a front edge of the bottom plate is recessed inward to form a second gap facing to the first gap, two opposite walls of the second gap are bent downward to form two second blocking arms, each of the docking modules includes a lower holding plate, the lower holding plate has a second locating plate, two opposite sides of the second locating plate are bent upward and then extend frontward to form two third side plates, front ends of the two second side plates are punched outward to form two elastic resisting portions, the shielding shell surrounds the first terminal module, the two second terminal modules, the two middle shielding plates and the two docking modules, the two first blocking arms are respectively fastened to upper portions of two facing surfaces of the two lower holding plates of the two docking modules, the two second blocking arms are respectively fastened to lower portions of the two facing surfaces of the two lower holding plates of the two docking modules, the two resisting portions respectively abut against two facing surfaces of the two third side plates.

10. A receptacle connector assembly, comprising:

a plurality of receptacle connectors stacked up and down and fastened together, the receptacle connector including:

a first terminal module including a first base block and two groups of first terminals, the first base block having a first fastening portion, upper portions of rear ends of two side surfaces of the first fastening portion protruding upward and outward to form two flanks, the two groups of the first terminals respectively fastened to the two flanks, rear ends of the first terminals projecting beyond rear surfaces of the two flanks, front ends of the first terminals projecting beyond front surfaces of the two flanks;

two second terminal modules of which each has a second base block and a group of second terminals, the second base blocks of the two second terminal modules being respectively fastened to bottom surfaces of the two flanks, the two groups of the second terminals being respectively fastened to the two second base blocks, rear ends of the second terminals projecting beyond rear surfaces of the second base blocks, front ends of the second terminals projecting beyond front surfaces of the second base blocks;

two middle shielding plates of which each is mounted between one of the flanks and the corresponding second base block, front ends of the middle shielding plates projecting beyond the front surfaces of the flanks and the second base blocks;

two docking modules of which each includes a docking portion, the docking portion defining a docking chamber penetrating through a front surface of the docking portion, the docking portion defining an assembling opening penetrating through a rear surface of the docking portion, the docking chamber and the assembling opening being isolated by an isolating board, a middle of the isolating board protruding frontward to form a tongue board, the docking portion defining a fastening slot longitudinally penetrating through a middle of the isolating board and extending to a front of the tongue board, and further penetrating through two opposite side surfaces of the tongue board, the docking portion defining a plurality of first terminal grooves penetrating through an upper portion of the isolating board and a top surface of the tongue board, and a plurality of second terminal grooves penetrating through a lower portion of the isolating board and a bottom surface of the tongue board, the two docking modules being mounted to two opposite sides of a front end of the first terminal module, the front ends of the two middle shielding plates and front ends of the two second terminal modules, the two opposite sides of the front end of the first terminal module and the front ends of the two second terminal modules being assembled to the assembling opening, the front ends of the middle shielding plates being fastened to the fastening slot, the front ends of the first terminals being fastened to the first terminal grooves and being exposed to the top surface of the tongue board, and the front ends of the second terminals being fastened to the second terminal grooves and being exposed to the bottom surface of the tongue board; and a shielding shell surrounding the first terminal module, the second terminal modules, the middle shielding plates and the docking modules;

wherein each of the docking modules includes two ground elements disposed symmetrically, the two ground elements have two fixing portions, outer sides of the two fixing portions are bent downward to form two soldering pieces, middles of front edges of the two fixing portions slantwise extend outward and frontward, and then are curved rearward to form two elastic contact portions with tail ends of the two elastic contact portions facing to and spaced from two inner sides of the two fixing portions, middles of two opposite sides of the docking portion are recessed inward to form two fixing slots, a middle of each of the fixing slots extends downward to form a locating groove, an inner wall of each of the fixing slots defines a perforation communicated with the fixing slot and the docking chamber, the two fixing portions are respectively fixed in the two fixing slots, the two elastic contact portions respectively pass through the two perforations to be inserted into the docking chamber, the two soldering pieces are located in the locating grooves.

11. The receptacle connector assembly as claimed in claim 10, wherein each of the flanks has a first base portion, a lower portion of a substantial middle of a front surface of the first base portion protrudes frontward to form a locating portion, the second base block has a second base portion, a middle of a front surface of the second base portion protrudes frontward to form a second fastening portion, the front ends of the first terminals project beyond front surfaces of the locating portions of the two flanks, the front ends of the second terminals project beyond front surfaces of the second fastening portions of the two second base blocks.

12. The receptacle connector assembly as claimed in claim 11, wherein each of the middle shielding plates has a third base plate, a substantial middle of a front surface of the third base plate protrudes frontward to form a fastening plate, two opposite sides of the front surface of the third base plate extend frontward to form two elastic arms, the third base plate of each of the middle shielding plates is disposed between one of the flanks and the corresponding second base block, the two locating portions are respectively corresponding to the two second fastening portions, rear ends of the fastening plate and the elastic arms of each of the middle shielding plates are clamped between the locating portion of one of the flanks and the corresponding second fastening portion, front ends of the fastening plate and the elastic arms of each of the middle shielding plates project beyond the front surfaces of the locating portion of one of the flanks and the corresponding second fastening portion, the locating portion of one of the flanks and the corresponding second fastening portion are assembled in the assembling opening, the two elastic arms of each of the middle shielding plates project into the docking chamber through the two opposite side surfaces of the tongue board.

13. The receptacle connector assembly as claimed in claim 12, wherein the two flanks are symmetrical to each other with respect to the first fastening portion, the front surfaces of the first base portions of the two flanks are inclined sideward, the two second terminal modules are symmetrical to each other, the front surfaces of the second base portions of the two second terminal modules are inclined sideward, the front surfaces of the third base plates of the two middle shielding plates are inclined sideward, the front surfaces of the first base portions of the two flanks are respectively flush with the front surfaces of the second base portions of the two second terminal modules, the front surfaces of the third base plates are respectively flush with the front surfaces of the first base portions of the two flanks, and the front surfaces of the third base plates are respectively flush with the front surfaces of the second base portions of the two second terminal modules.

14. The receptacle connector assembly as claimed in claim 10, wherein the first terminal module further includes an upper shell, the upper shell has a first base plate, two first side plates bent downward from two opposite sides of the first base plate, and a first front plate perpendicularly connected with a front edge of the first base plate and located between the two first side plates, rear ends of the two first side plates define two notches penetrating through bottom surfaces and rear surfaces of the rear ends of the two first side plates, several portions of a top wall of each of the notches extend downward to form a plurality of first insertion slices, the first base block defines two first narrow slots penetrating through tops of inner sides of the two flanks, and two second narrow slots penetrating through bottoms of the inner sides of the two flanks, the second narrow slot and the first narrow slot of each of the flanks are isolated by an isolating wall, the isolating wall defines a plurality of insertion holes penetrating through a top surface and a bottom surface of the isolating wall and arranged longitudinally, the first base plate is disposed on a top surface of the first fastening portion, the first front plate is fastened to an upper portion of a front surface of the first fastening portion, the two first side plates are respectively fastened to upper portions of the two side surfaces of the first fastening portion, rear ends of the two first side plates are inserted into the two first narrow slots, the first insertion slices are inserted into the insertion holes through the first narrow slots.

15. The receptacle connector assembly as claimed in claim 14, wherein the first terminal module further includes a lower shell, the lower shell has a second base plate, two second side plates extended upward from two opposite sides of the second base plate, and a second front plate perpendicularly connected with a front edge of the second base plate and located between the two second side plates, a top edge of each of the second side plates is recessed downward to form a limiting groove, the second base plate of the lower shell is disposed to a bottom surface of the first fastening portion, the second front plate is fastened to a lower portion of the front surface of the first fastening portion, the two second side plates are respectively fastened to lower portions of the two side surfaces of the first fastening portion, tops of rear ends of the two second side plates are inserted into the two second narrow slots, a bottom of the isolating wall is limited in the limiting groove, inner surfaces of upper ends of the two second side plates are attached to outer surfaces of lower ends of the two first side plates.

16. The receptacle connector assembly as claimed in claim 15, wherein the shielding shell has a top plate, two lateral plates extended downward from two opposite sides of the top plate, and a bottom plate connected between bottoms of the two lateral plates, a middle of a front edge of the top plate is recessed inward to form a first gap, two opposite walls of the first gap are bent downward to form two first blocking arms, a middle of a front edge of the bottom plate is recessed inward to form a second gap facing to the first gap, two opposite walls of the second gap are bent downward to form two second blocking arms, each of the docking modules includes a lower holding plate, the lower holding plate has a second locating plate, two opposite sides of the second locating plate are bent upward and then extend frontward to form two third side plates, front ends of the two second side plates are punched outward to form two elastic resisting portions, the shielding shell surrounds the first terminal module, the two second terminal modules, the two middle shielding plates and the two docking modules, the two first blocking arms are respectively fastened to upper portions of two facing surfaces of the two lower holding plates of the two docking modules, the two second blocking arms are respectively fastened to lower portions of the two facing surfaces of the two lower holding plates of the two docking modules, the two resisting portions respectively abut against two facing surfaces of the two third side plates.

17. The receptacle connector assembly as claimed in claim 16, further comprising a fastening piece, the fastening piece having a restricting plate, two portions of a top edge of the restricting plate being bent rearward to form two clamping plates, two portions of a bottom edge of the restricting plate being bent rearward to form another two clamping plates, two opposite sides of the restricting plate being bent frontward to form two blocking plates, the restricting plate being disposed to the front surfaces of the first fastening portions, the clamping plates being respectively soldered to the top plate of the shielding shell of the receptacle connector located at a top of the receptacle connector assembly and the bottom plate of the shielding shell of the receptacle connector located at a bottom of the receptacle connector assembly, the two blocking plates being soldered to the first blocking arms and the second blocking arms.

18. The receptacle connector assembly as claimed in claim 16, further comprising two fastening pillars, the first fastening portion defining two first fastening holes, the first base plate defining two second fastening holes respectively corresponding to the two first fastening holes, the second base plate defining two third fastening holes respectively corresponding to the two first fastening holes, the top plate of the shielding shell defining two fourth fastening holes respectively corresponding to the two first fastening holes, the bottom plate of the shielding shell defining two fifth fastening holes respectively corresponding to the two first fastening holes, each of the fastening pillars being fastened in the fourth fastening hole, the second fastening hole, the first fastening hole, the third fastening hole and the fifth fastening hole of each of the receptacle connectors.

19. The receptacle connector assembly as claimed in claim 16, wherein the receptacle connectors include a first receptacle connector, a second receptacle connector and a third receptacle connector which are stacked up and down, rear ends of the top surface and the bottom surface of the first fastening portion protrude outward to form two protruding blocks, two opposite sides of the bottom plate of the shielding shell of the first receptacle connector protrude downward to form two lower protruding pillars, two opposite sides of the top plate of the shielding shell of the third receptacle connector protrude upward to form two upper protruding pillars, the protruding block of the bottom surface of the first fastening portion of the first receptacle connector abuts against the protruding block of the top surface of the first fastening portion of the second receptacle connector, the two lower protruding pillars of the shielding shell of the first receptacle connector abut against the top plate of the shielding shell of the second receptacle connector, the protruding block of the bottom surface of the first fastening portion of the second receptacle connector abuts against the protruding block of the top surface of the first fastening portion of the third receptacle connector, the upper protruding pillars of the shielding shell of the third receptacle connector abut against the bottom plate of the shielding shell of the second receptacle connector.

20. A receptacle connector, comprising:

a first terminal module including a first base block and two groups of first terminals, the first base block having a first fastening portion, upper portions of rear ends of two side surfaces of the first fastening portion protruding upward and outward to form two flanks, the two groups of the first terminals respectively fastened to the two flanks, rear ends of the first terminals projecting beyond rear surfaces of the two flanks, front ends of the first terminals projecting beyond front surfaces of the two flanks;

two second terminal modules of which each has a second base block and a group of second terminals, the second base blocks of the two second terminal modules being respectively fastened to bottom surfaces of the two flanks, the two groups of the second terminals being respectively fastened to the two second base blocks, rear ends of the second terminals projecting beyond rear surfaces of the second base blocks, front ends of the second terminals projecting beyond front surfaces of the second base blocks;

two middle shielding plates of which each is mounted between one of the flanks and the corresponding second base block, front ends of the middle shielding plates projecting beyond the front surfaces of the flanks and the second base blocks;

two docking modules of which each includes a docking portion, the docking portion defining a docking chamber penetrating through a front surface of the docking portion, the docking portion defining an assembling opening penetrating through a rear surface of the docking portion, the docking chamber and the assembling opening being isolated by an isolating board, a middle of the isolating board protruding frontward to form a tongue board, the docking portion defining a fastening slot longitudinally penetrating through a middle of the isolating board and extending to a front of the tongue board, and further penetrating through two opposite side surfaces of the tongue board, the docking portion defining a plurality of first terminal grooves penetrating through an upper portion of the isolating board and a top surface of the tongue board, and a plurality of second terminal grooves penetrating through a lower portion of the isolating board and a bottom surface of the tongue board, the two docking modules being mounted to two opposite sides of a front end of the first terminal module, the front ends of the two middle shielding plates and front ends of the two second terminal modules, the two opposite sides of the front end of the first terminal module and the front ends of the two second terminal modules being assembled to the assembling opening, the front ends of the middle shielding plates being fastened to the fastening slot, the front ends of the first terminals being fastened to the first terminal grooves and being exposed to the top surface of the tongue board, the front ends of the second terminals being fastened to the second terminal grooves and being exposed to the bottom surface of the tongue board; and a shielding shell surrounding the first terminal module, the second terminal modules, the middle shielding plates and the docking modules;

wherein each of the flanks has a first base portion, a lower portion of a substantial middle of a front surface of the first base portion protrudes frontward to form a locating portion, the second base block has a second base portion, a middle of a front surface of the second base portion protrudes frontward to form a second fastening portion, the front ends of the first terminals project beyond front surfaces of the locating portions of the two flanks, the front ends of the second terminals project beyond front surfaces of the second fastening portions of the two second base blocks;

wherein front ends of a top surface and a bottom surface of the docking portion are recessed inward to form a first lacking groove and a second lacking groove, front ends of the first lacking groove and the second lacking groove are communicated with the docking chamber, rear ends of the top surface and the bottom surface of the docking portion are recessed inward to form a first recess and a second recess, each of the docking modules includes an upper holding plate and a lower holding plate, the upper holding plate has a first locating plate, a front edge of the first locating plate extends frontward, then is arched downward and further protrudes upward to form a first resilient portion, the lower holding plate has a second locating plate, the second locating plate defines a first mouth penetrating through a middle of a front edge of the second locating plate, a rear wall of the first mouth meanders frontward to form a second connecting portion, a free end of the second connecting portion is arched upward and then extends downward to form a second resilient portion, the first locating plate is located in the first recess, the first resilient portion is disposed in the first lacking groove, the second locating plate is disposed to the bottom surface of the docking portion, the second connecting portion is disposed in the second recess, the second resilient portion is disposed in the second lacking groove.

* * * * *